US010323392B2

(12) United States Patent
Christiansen

(10) Patent No.: US 10,323,392 B2
(45) Date of Patent: Jun. 18, 2019

(54) COOLED WATER RECOVERY METHOD AND APPARATUS

(71) Applicant: Kenneth Michael Christiansen, Torrance, CA (US)

(72) Inventor: Kenneth Michael Christiansen, Torrance, CA (US)

( * ) Notice: Subject to any disclaimer, the term of this patent is extended or adjusted under 35 U.S.C. 154(b) by 74 days.

(21) Appl. No.: 15/257,725

(22) Filed: Sep. 6, 2016

(65) Prior Publication Data

US 2017/0067235 A1 Mar. 9, 2017

Related U.S. Application Data

(60) Provisional application No. 62/213,992, filed on Sep. 3, 2015.

(51) Int. Cl.
*E03C 1/05* (2006.01)
*E03B 7/04* (2006.01)

(52) U.S. Cl.
CPC ..... *E03B 7/045* (2013.01); *E03C 1/05* (2013.01)

(58) Field of Classification Search
CPC ..... E03C 1/05; E03B 7/045
See application file for complete search history.

(56) References Cited

U.S. PATENT DOCUMENTS 4,854,499 A 8/1989 Neuman
5,165,456 A 11/1992 Woolman
5,524,666 A 6/1996 Linn
6,164,307 A 12/2000 Byles
7,178,543 B2 2/2007 Adams
2008/0271238 A1* 11/2008 Reeder ..... A46B 7/04 4/597
2013/0291948 A1* 11/2013 Mc Queen ..... E04H 4/129 137/1

FOREIGN PATENT DOCUMENTS

EP 1033515 A2 9/2000

OTHER PUBLICATIONS

Wilson (2009). "Waiting for Hot Water," Retrieved Aug. 10, 2016 from <http://www.greenbuildingadvisor.com/blogs/dept/energy-solutions/waiting-hot-water>.

* cited by examiner

*Primary Examiner* — P. Macade Nichols
(74) *Attorney, Agent, or Firm* — Morrison & Foerster LLP

(57) ABSTRACT

A method and apparatus for solving a prevailing problem that occurs when cooled water accumulated in hot water pipelines is wasted down the drain while an individual waits for the discharge of hot water at a point-of-use is described. The described water recovery method and apparatus prevents the waste of usable cooled water accumulated in the hot water pipelines by utilizing a diverter unit with a three-way diverter valve, a solenoid valve, and a thermo-switch to implement a cycle that diverts the accumulated cooled water to a holding container before it can be discharged at the point-of-use and allows only hot water to pass through and reach the point-of-use. As a result, the described water recovery process and apparatus allows valuable fresh water to be stored and conserved for later use.

18 Claims, 8 Drawing Sheets

COOLED WATER RECOVERY METHOD AND APPARATUS

CROSS-REFERENCE TO RELATED APPLICATIONS

This application claims priority to U.S. Provisional Application Ser. No. 62/213,992, filed Sep. 3, 2015, entitled "Electrically Powered Set of Valves Controlled by a Series of Switches and Relays that Directs the Cooled Water in a Hot Water Line to a Holding Container Until Hot Water Reaches the Desired Temperature, Then Redirects it Back to a Point of Use," which is incorporated herein by reference in its entirety.

BACKGROUND

Field

The present disclosure relates to a water conservation process and apparatus and, more specifically, to diverting accumulated water within hot water pipelines through the use of a diverter unit having an electrically-powered and controlled set of valves.

Description of the Related Art

A significant amount of fresh and usable water is wasted daily in sinks and showers of an individual's residence. Specifically, this waste occurs during the operational lag time between when hot water is requested at a point-of-use, such as a faucet, and when hot water from a hot water source reaches the point-of-use via hot water pipelines. During this time, water that is already in the pipelines (e.g., accumulated during the lag time of a prior use of hot water) is drained from the system until new hot water from the hot water source reaches the faucet, thereby causing a significant amount of fresh and usable water to go wasted down the drain.

To date, the main solution adapted by individuals to address this problem has been to place a bucket or container in the sink or shower to catch the initial flow of cooled water during the lag time between when hot water is requested at the faucet and hot water from a hot water source reaches the faucet.

This method, however, is cumbersome, for the individual must remember to catch the initial flow of water each time hot water is used at the sink or shower. Further, depending upon the amount of accumulated cooled water in the hot water pipelines, the container holding the initial flow of accumulated cooled water may become very heavy, thus presenting an injury hazard as the individual repeatedly moves a bucket full of water out of the sink or shower on a regular basis. In addition, the individual must manually determine when the hot water has reached the faucet by placing his or her hand in the flowing water, at which point some hot water will have already been wasted into the bucket or down the drain without being used.

Alternatively, a recirculation method exists where accumulated water in the pipelines re-circulated back to the hot water source when hot water is requested at a point-of-use. This recirculation can be achieved by installing a separate set of return pipelines or by retrofitting the existing pipelines such that the accumulated cooled water is re-directed to the cold water pipelines.

However, this method requires that water be constantly recirculated through the entire system using a heating source that uses, for example, a 120 volt pump and a return line that leads all the way back to the heating source. Because the system must be on 24/7, the system uses an extreme amount of energy to both pump the water and to heat it. Further, such a system is difficult to install, as installation generally requires one of high expertise, such as a professional plumber, and further requires considerable alterations to the existing pipe system of the building. In addition to these difficulties, installing such a system requires significant financial cost.

A method also exists where an individual places a tank with an electric heating element at every point-of-use (e.g., under the sink). This reduces the time that hot water travels from its source to the point-of-use, thereby reducing the amount of cooled water that is sent down the drain before the hot water reaches the point-of-use.

However, this method is also problematic in that it is difficult to install for a shower, where the majority of the water in a typical household is wasted. Further, as with the recirculation method, it requires that all tanks be heated 24/7, which requires an extreme amount of energy.

Therefore, it is desirable to have a method and apparatus for recovering all or substantially all of the accumulated cooled water normally sent down the drain while waiting for hot water to be discharged at a point-of-use without the drawbacks of existing methods and systems. In particular, there is a need for an easily installable, affordable, and energy efficient apparatus that can be used to address the above discussed problem in a variety of settings where fresh and usable water can be recovered and conserved at a point-of-use.

SUMMARY

An apparatus having an electrically-powered and controlled set of valves for diverting accumulated water within hot water pipelines normally sent down the drain while waiting for hot water to be discharged at a point-of-use is described. The apparatus may be a diverter unit configured to be activated by an activation switch, the diverter unit comprising: an inlet port configured to receive water from a hot water source; a first outlet port configured to release water to a point-of-use; a second outlet port configured to release water to a holding container; a three-way diverter valve configured to: direct water from the inlet port towards the first outlet port in a first position, direct water from the inlet port towards the second outlet in a second position, and switch from the first position to the second position upon activation of the activation switch; a thermoswitch positioned between the diverter valve and the inlet port, wherein the thermoswitch is configured to activate upon detecting that the temperature of passing water is at or above a hot water temperature; a solenoid valve positioned between the diverter valve and the first outlet port, the solenoid valve configured to open upon activation of the thermoswitch; and the three-way diverter valve configured to switch from the second position back to the first position upon activation of the thermoswitch.

In some examples, the solenoid valve may be configured to remain open while the thermoswitch is activated and close upon deactivation of the thermoswitch. In some examples, the solenoid valve may be a normally-closed solenoid valve.

In some examples, the three-way diverter valve may be a motorized three-way diverter valve. In some examples, the thermoswitch may be a thermostat snap disc (SPDT).

In some examples, the activation switch may be a momentary pushbutton. In some examples, the activation switch may be a responder device to a remote control device. In some examples, the activation switch may be an internal switch configured to be installed in a single-handle faucet and activates upon detecting that the single-handle faucet is moved to a hot water position. In some examples, activation of the activation switch may cause activation of a visual indicator.

In some examples, the diverter unit may include a battery port and is powered via a battery.

A method for diverting accumulated water within hot water pipelines normally sent down the drain while waiting for hot water to be discharged at a point-of-use using a diverter unit having an electrically-powered and controlled set of valves is also described. The diverter unit may be connected to an activation switch, wherein the diverter unit has an inlet port, a first outlet port, a second outlet port, a solenoid valve, a thermoswitch and a diverter valve, and wherein the diverter valve is in a first position configured to direct water flow from the inlet port to the first outlet port. The method may comprise: receiving an activation signal from the activation switch; switching, in response to receiving the activation signal, the position of the diverter valve from the first position to a second position configured to direct water flow from the inlet port to the second outlet port; detecting, using the thermoswitch, the temperature of water received through the inlet port; and switching the position of the diverter valve to the first position and opening the solenoid valve in response to detecting that the temperature of the received water is at or above a hot water temperature.

In some examples, the method may further comprise: continuing to detect, using the thermoswitch, that the temperature of the received water is at or above the hot water temperature; maintaining the solenoid valve in the open position if the temperature of the received water remains at or above the hot water temperature; and closing the solenoid valve if the temperature of the received water falls below the hot water temperature. In some examples, the solenoid valve may be a normally-closed solenoid valve.

In some examples, the three-way diverter valve may be a motorized three-way diverter valve. In some examples, the thermoswitch may be a thermostat snap disc (SPDT).

In some examples, the activation switch may be a momentary pushbutton. In some examples, the activation switch may be a responder device to a remote control device. In some examples, the activation switch may be an internal switch configured to be installed in a single-handle faucet and activates upon detecting that the single-handle faucet is moved to a hot water position. In some examples, activation of the activation switch may cause activation of a visual indicator.

In some examples, the diverter unit may include a battery port and is powered via a battery.

BRIEF DESCRIPTION OF THE FIGURES

The present application can be best understood by reference to the following description taken in conjunction with the accompanying drawing figures, in which like parts may be referred to by like numerals.

DETAILED DESCRIPTION

The following description is presented to enable a person of ordinary skill in the art to make and use the various embodiments. Descriptions of specific components, steps, and applications are provided only as examples. Various modifications to the examples described herein will be readily apparent to those of ordinary skill in the art, and the general principles defined herein may be applied to other examples and applications without departing from the spirit and scope of the disclosed invention. Thus, the disclosed invention is not intended to be limited to the examples described herein and shown, but is to be accorded the scope consistent with the claims.

Provided herein is a method and apparatus for solving a prevailing problem that occurs when cooled water accumulated in hot water pipelines is wasted down the drain while an individual waits for the discharge of hot water at a point-of-use is described. In general, this problem occurs because of the long distance that hot water must travel from its originating location to the point-of-use. For example, in a typical hot water system, hot water must travel from a central hot water source, via pipelines, to reach a point-of-use outlet, such as a sink faucet or a shower head. The length of the pipelines that the hot water must travel determines the amount of cooled water that may be accumulated and remaining in the pipelines.

The water recovery method and apparatus described below prevents the waste of usable cooled water accumulated in the pipelines by utilizing a diverter unit to implement a cycle that diverts the accumulated cooled water to a holding container before it can be discharged at the point-of-use. As a result, the described water recovery method and apparatus allows valuable fresh water to be stored and conserved for later use.

Figure 1:
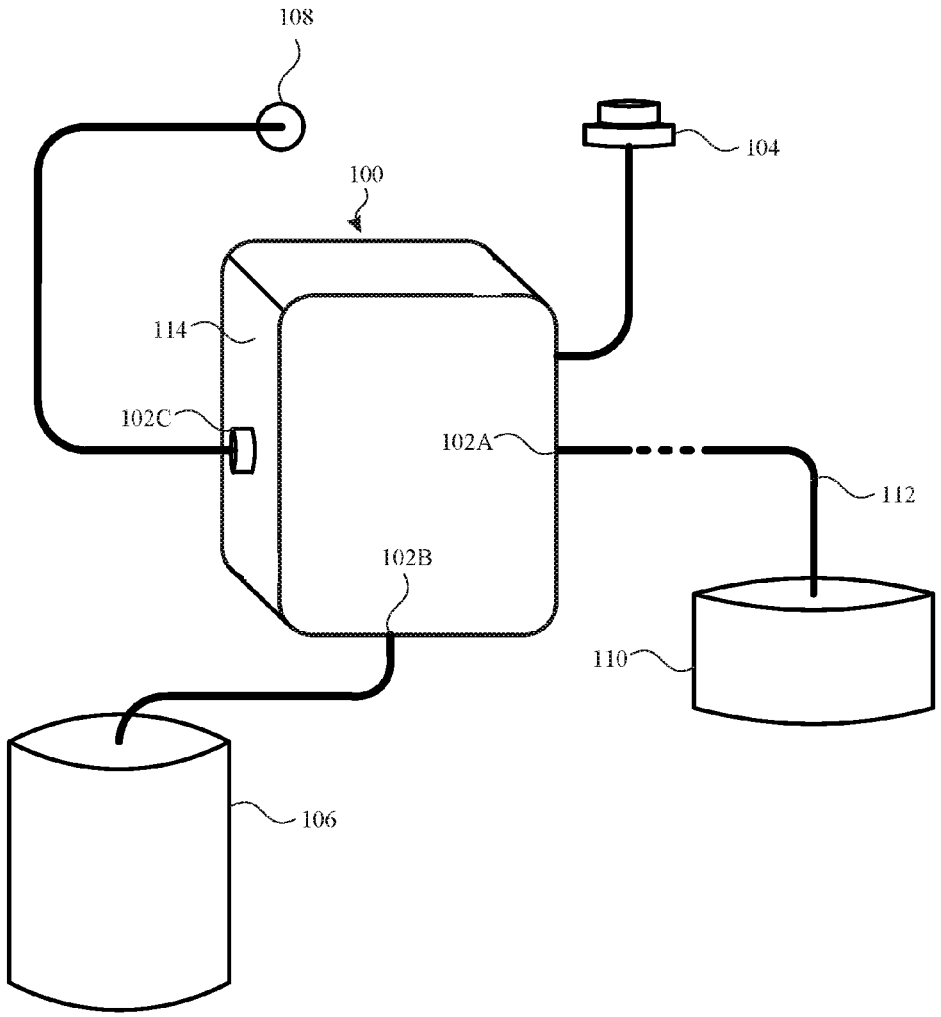
FIG. 1 illustrates a general overview of an exemplary diverter unit installed at a point-of-use.

FIG. 1 depicts an exemplary diverter unit 100 connected to a hot water line 112 that receives water for an external hot water source 110 and to a point-of-use 108. The point-of-use 108 may be, for example, a sink faucet or a shower head in a kitchen or a bathroom, respectively. The hot water source 110 may be, for example, the central water heating system of a home, building, or vehicle.

Figure 2:
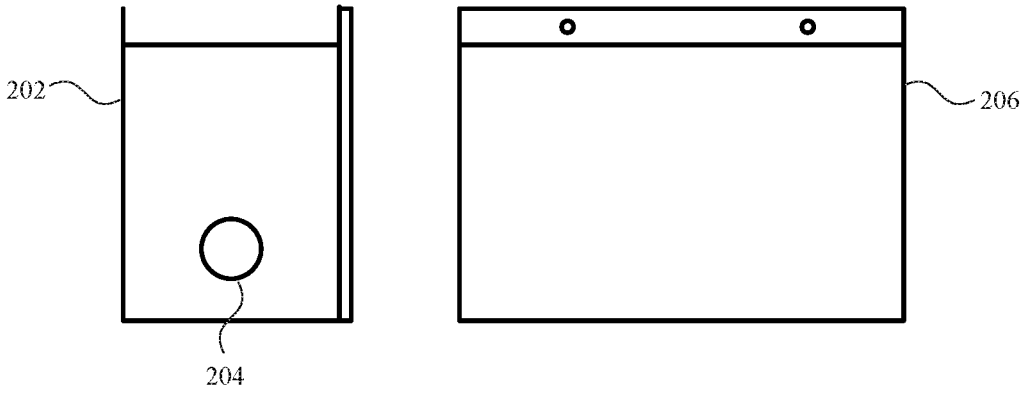
FIG. 2 illustrates a housing of an exemplary diver unit.

In some embodiments, the diverter unit 100 includes a housing 114 that houses the various components within the diverter unit 100 discuss below. FIG. 2 depicts a side view 202 and a front view 206 of an exemplary housing 114 for the diverter unit 100. As shown in FIG. 2, a side 202 of the housing 114 may have a hole 204 to install an inlet port or an outlet port for connecting the diverter unit 100 to external water lines, as discussed in greater detail below. A side 202 of the housing 114 may be, for example, 4 inches wide and 5 inches tall. As also shown in FIG. 2, a front 206 of the housing 114 may cover and protect the various components within the diverter unit 100 and, together with sides 202, form the diverter unit housing 114 as depicted in FIG. 1. A front 206 of the housing 114 may be, for example, 10 inches wide and 5 inches tall.

In other embodiments, however, the diverter unit 100 may be installed without the housing 114. For example, the various components of the diverter unit 100 may instead be directly installed inside a wall or other structure of a building or vehicle, with a user having access to a visible button 104 to initiate the cycle. In some examples, the visible button 104 may be waterproof.

The diverter unit 100 includes an inlet port 102A that receives hot water from the external hot water source 110, an outlet port 102B that discharges accumulated water in the hot water line 112 into a holding container 106, and an outlet port 102C that releases water to the point-of-use 108.

The described water recovery process using the diverter unit 100 is initiated by activating a hot water request switch 104. To activate the diverter unit 100 and therefore start the cycle, a user activates the hot water request switch 104. In some embodiments, the hot water request switch 104 may be a pushbutton, such as a momentary pushbutton, connected to the diverter unit 100, as depicted in FIG. 1. Therefore, a user can request hot water at the point-of-use 108 by manually pressing the pushbutton 104.

Figure 3:
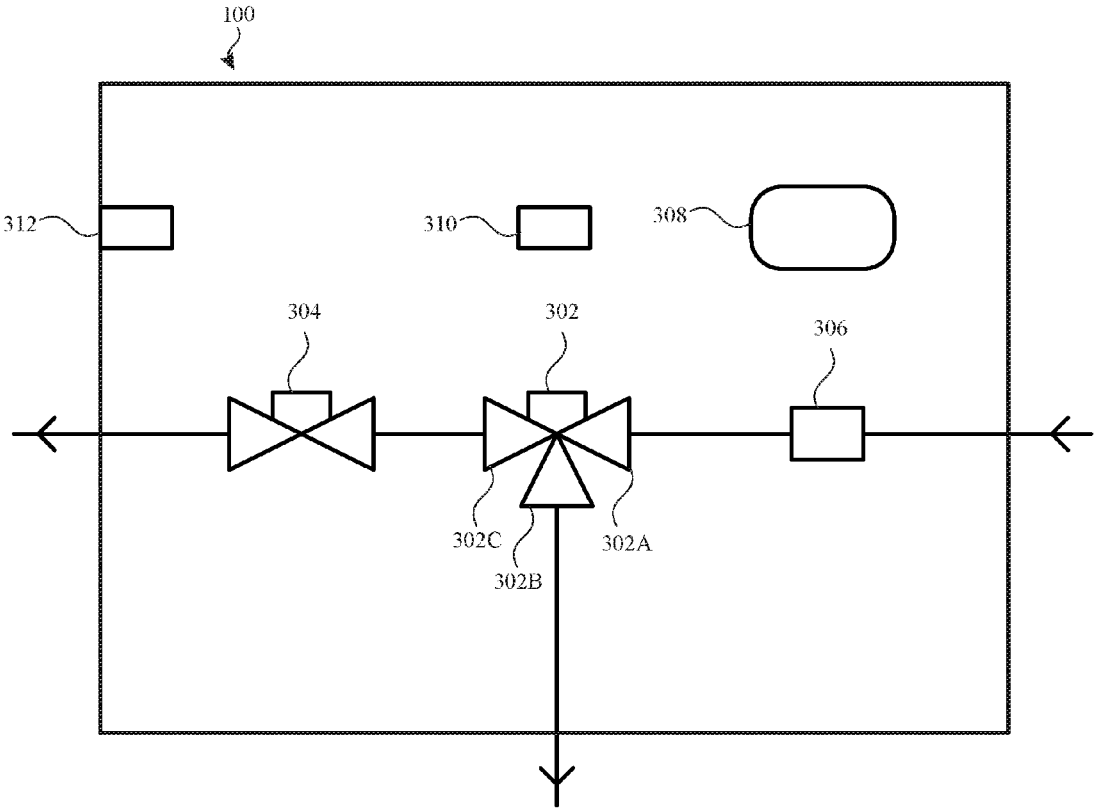
FIG. 3 illustrates a schematic diagram of the central components of an exemplary diverter unit.

FIG. 3 depicts a schematic diagram of the central components of the exemplary diverter unit 100 of FIG. 1. A three-way diverter valve 302 connects the inlet port 102A to the outlet port 102C in a flow-through position and connects the inlet port 102A to the outlet port 102B in a diverted position. In some examples, the three-way diverter valve 302 is a motorized three-way diverter valve. For example, the diverter valve 302 may be a motorized hold-actuated diverter valve or a reversing-motor diverter valve.

Figure 4:
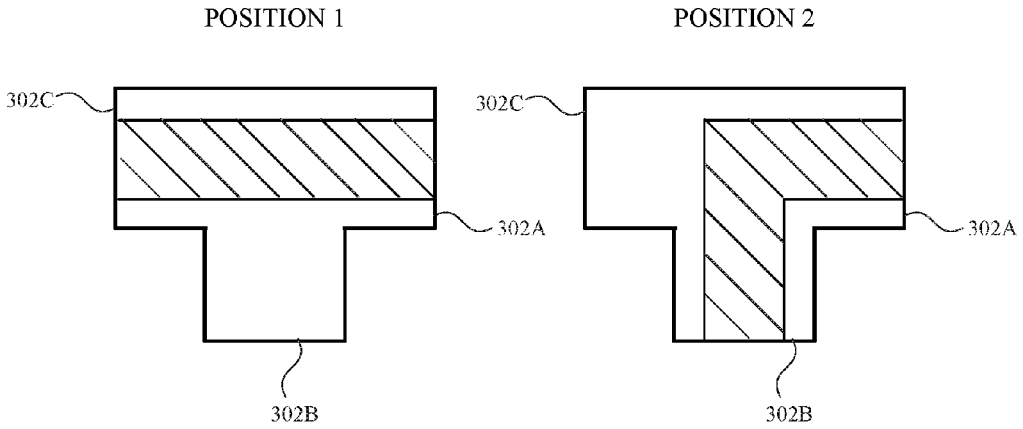
FIG. 4 illustrates representations of water flowing through a three-way diverter valve of an exemplary diverter unit in its two possible positions.

The three-way diverter valve includes an inlet 302A that receives water flowing into the diverter unit 100 through the inlet port 102A, an outlet 302B that diverts water towards the outlet port 102B leading to the holding container 106, and an outlet 302C that releases water through the valve and towards the outlet port 102C leading to the point-of-use 108. As depicted in FIG. 4, in the flow-through position ("Position 1"), water flows through the diverter valve 302 from the inlet 302A to the outlet 302C, and, in the diverted position ("Position 2"), water diverts in the diverter valve 302 from the inlet 302A to the outlet 302B.

A solenoid valve 304 is located between the outlet 302C of the three-way diverter valve 302 and the outlet port 102C leading to the point-of-use 108. A thermoswitch 306 is located between the inlet 302A of the three-way diverter valve 108 and the inlet port 102A. The thermoswitch 306 controls the switching of the three-way diverter valve 302 and the opening and closing of the solenoid valve 304.

In some examples, the thermoswitch 306 is a thermostat snap disc (SPDT) configured to change contacts at a pre-set temperature. For example, the SPDT may change contacts at 120 degrees Fahrenheit because, typically, the temperature of water from a hot water source is 120-140 degrees Fahrenheit. In some examples, the temperature at which the SPDT changes contacts may be adjusted or set by the user.

The thermoswitch 306 may be mounted on the inlet port 102A, on the inlet 302A of the three-valve diverter valve 302 that receives water from the inlet port 102A, or at a location between the three-way diverter valve 302 and the inlet port 102A.

A power sack 312 powers the diverter unit 100. In some embodiments, the diverter unit 100 is connected to an outlet. In some embodiments, the diverter unit 100 includes one or more battery ports to hold batteries. Having the capability of being battery-powered increases the portability and versatility of the diverter unit 100. For example, the diverter unit 100 can be installed to a sink at a location where an outlet may not easily be accessible, such as in the kitchen of a recreational vehicle. In some embodiments, the diverter unit 100 also includes a fuse holder 310 as a safety precaution.

Figure 5:
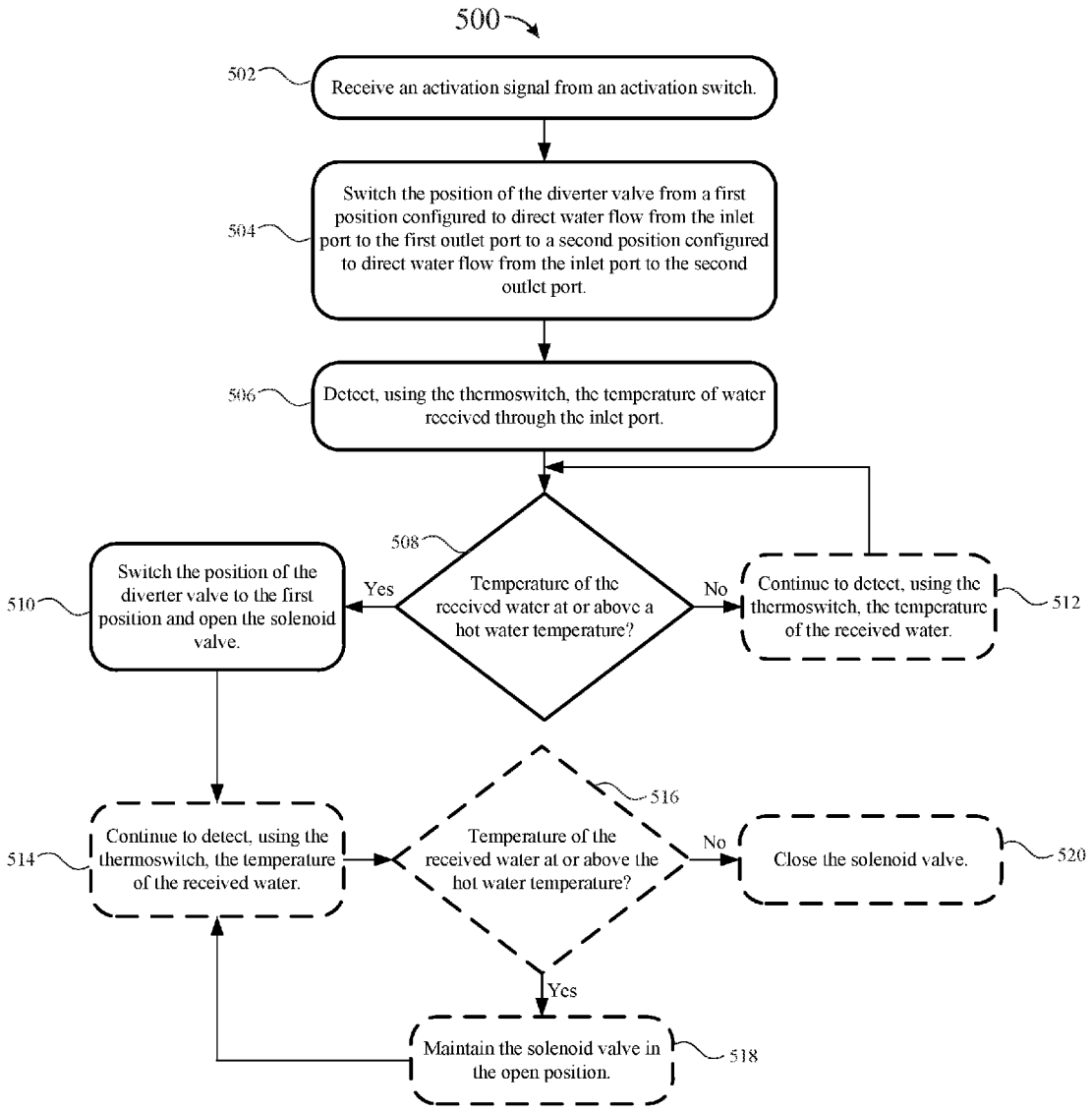
FIG. 5 illustrates a flow diagram of an exemplary water recovery process implemented using the exemplary diverter unit described with reference to FIGS. 1-4.

FIG. 5 illustrates an exemplary process of the described water conservation method implemented using the diverter unit 100 described with reference to FIGS. 1-4 installed for use at, for example, a sink faucet.

At step 502, the diverter unit 100 receives a signal from an activation switch indicating that the activation switch has been activated. As discussed above, the activation switch may be a button (e.g., the pushbutton 104) wired to the diverter unit 100 and which can be manually pressed by a user to request hot water at the faucet. Prior to activation of the activation switch, no hot water is allowed to flow to the point-of-use because the solenoid valve 304 is closed. Activation of the activation switch begins the cycle.

At step 504, in response to receiving the activation signal from the activation switch, the diverter valve 302 in the diverter unit 100 switches from Position 1 (e.g., the flow-through position) to Position 2 (e.g., the diverted position). In Position 2, the diverter valve 302 directs the accumulated water in the hot water line 112 towards the holding container 106 for storage.

While the accumulated water in the hot water line 112 is being diverted to the hold container 106, hot water from an external hot water source 110 is flowing towards the diverter unit 100. At step 506, the diverter unit 100 detects, using the thermoswitch 306, the temperature of the water flowing into the diverter unit 100 through the inlet port 102A.

At step 508, if the thermoswitch 306 detects that the water flowing in through the inlet port 102A is at or above a hot water temperature (e.g., 120 degrees Fahrenheit), the diverter valve 302 reverts back to Position 1 from Position 2, as described at step 510. However, if the thermoswitch 306 does not detect that the water flowing in through the inlet port 102A is at or above a hot water temperature, the thermoswitch 206 continues to detect the temperature of the water received from the hot water line 112 and in through the inlet port 102A, as described at step 512, until hot water is detected.

At step 514, the solenoid valve 304 opens in response to detecting that the temperature of the received water is at or above the hot water temperature. Therefore, because the diverter valve 302 is in Position 1 and the solenoid valve 304 is open, hot water received through the inlet port 102A from the hot water line 112 flows through the diverter unit 100 and out of the outlet port 102C leading to the point-of-use 108 for use by the user.

In some embodiments, at step 514, the diverter unit 100 continues to detect, using the thermoswitch 306, the temperature of the water received through the inlet port 102A if water continues to be received from the hot water line 112. At step 516, if the thermoswitch 306 continues to detect that the water flowing in through the inlet port 102A is at or above the hot water temperature, the solenoid valve 304 is maintained in the open position and the thermoswitch 306 continues to detect the temperature of the water, as described at step 518. Therefore, hot water from the external hot water source 110 continues to flow through the diverter unit 100 and to the point-of-use 108. At step 520, if the thermoswitch 306 detects that the water is no longer at or above the hot water temperature, the solenoid valve 304 is closed, thereby ending the cycle. At this point, hot water no longer reaches the point-of-use 108.

1. Pushbutton

The diverter unit 100 may be used in a pushbutton configuration. For example, FIG. 1 depicts the diverter unit 100 in a pushbutton configuration. In the pushbutton configuration, the diverter unit 100 is activated in the same manner (e.g., using the button 104) regardless of the type of faucet (e.g., a double-handle faucet or a single-handle faucet) at the point-of-use 108.

In one exemplary embodiment, when hot water is needed at the point-of-use 108, the button 104 (e.g., a momentary pushbutton) that is external to the casing of the diverter unit 100 is pushed to manually initiate the cycle. Further, an indicator light may be placed near the faucet to indicate to the user that the button 104 has been pressed, and thus that the cycle is active. At first, no hot water flows through the diverter unit 100 because the solenoid valve 304 is closed.

When the button 104 is pushed, a relay 308 in the diverter unit 100 closes. Closing of the relay 308 in turn causes activation of the motorized three-way diverter valve 302, thereby moving the valve from Position 1 to Position 2. In Position 2, the three-way diverter valve 302 allows the accumulated cooled water in the hot water line 112 to flow from the inlet 302A to the outlet 302B of the three-way diverter valve 302 and towards the holding container 106 to be stored for later use.

While the accumulated cooled water is being diverted to the holding container 106, hot water flows through the hot water line 112 from the hot water source 110 and reaches the diverter unit 100. A thermoswitch 306 is located between the inlet port 102A of the diverter unit 100 and the inlet 302A of the motorized three-way diverter valve 302. In this exemplary embodiment, the thermoswitch 306 is a thermostat snap disc (SPDT) located on the copper nipple just before the motorized three-way diverter valve 302.

The SPDT 306 switches to the other contact upon detecting that the temperature of passing water is 120 degrees Fahrenheit. The switching of contacts by the SPDT 306 causes the motorized three-way diverter valve 302 to revert back to Position 1 from Position 2 and the solenoid valve 304 to open, allowing hot water to flow through the diverter valve 302 and the solenoid valve 304 and to the faucet.

When the hot water faucet is turned off and the hot water in the hot water line cools after a period of time, the SPDT 306 returns to its initial position, thus de-energizing the solenoid valve 304 and ending the cycle.

A list of components that may make up the diverter unit 100 in pushbutton configuration in accordance with this exemplary embodiment and how the various components can be put together are provided below:

(1) 12 vdc power supply input jack;
(2) fuse holder;
(3) 12 vdc, n/c, ½" solenoid valve;
(4) 12 vdc, motorized, ½", three-way diverter valve (wires are reversed for return to Position 1);
(5) thermostat snap disc (SPDT) that changes contacts at 120 degrees Fahrenheit;
(6) diverter unit housing;
(7) 7 blue wire nuts;
(8) 2" piece of ½" plastic tube;
(9) 120 vac to 12 vdc power supply with 500 ma. output max and 3' plug-in cord (secondary);
(10) 2 mounting brackets with 2 screws each;
(11) 2½" npt to ½" tubing male adapter;
(12) 1 double pole double throw (DPDT) alternating relay with 12 vdc coil;
(13) 2 hose clamps;
(14) 1½"×3" copper nipple, type m, with ½" npt, male threads on both ends;
(15) 1 momentary pushbutton switch; and
(16) 5' of 28 awg, 4-pair, insulated wire.

The diverter unit housing (6) may have 10 mounting studs for mounting screws, a screw on cover with 3¾" cut outs and 2⅜" cut outs for plumbing and wiring, respectively. The mounting brackets (10) are attached to the 12 vdc solenoid valve (3) and the 12 vdc, motorized three-way diverter valve (4). Components (1), (2), (3), and (4) are then mounted to the diverter unit base (6). A ½" copper nipple (type "m"), with 3" long w/½" NPS male threads on each end (17), is threaded into the 12 vdc, three-way diverter valve (4) on the hot water inlet side of the valve. A 120 degree thermostat snap disc (5) is mounted on the 3" copper nipple (of the hot water inlet side) (17) midway. ½" npt to ½" tubing, male adapters (11) are installed on the left side (outlet side leading to the point-of-use) of the three-way diverter valve (4) and the right side (side facing the diverter valve) of the 12 vdc solenoid valve (3). ½" tubing 2" long (8) is installed between the solenoid valve (3) and the three-way diverter valve (4) using the 2 hose clamps (13). The momentary pushbutton (15) is installed at a desired location and the 4-pair, 28 awg wire (15) is run from the pushbutton (15) into the housing (6) to connect the pushbutton to the housing of the diverter unit 100.

Figure 6:
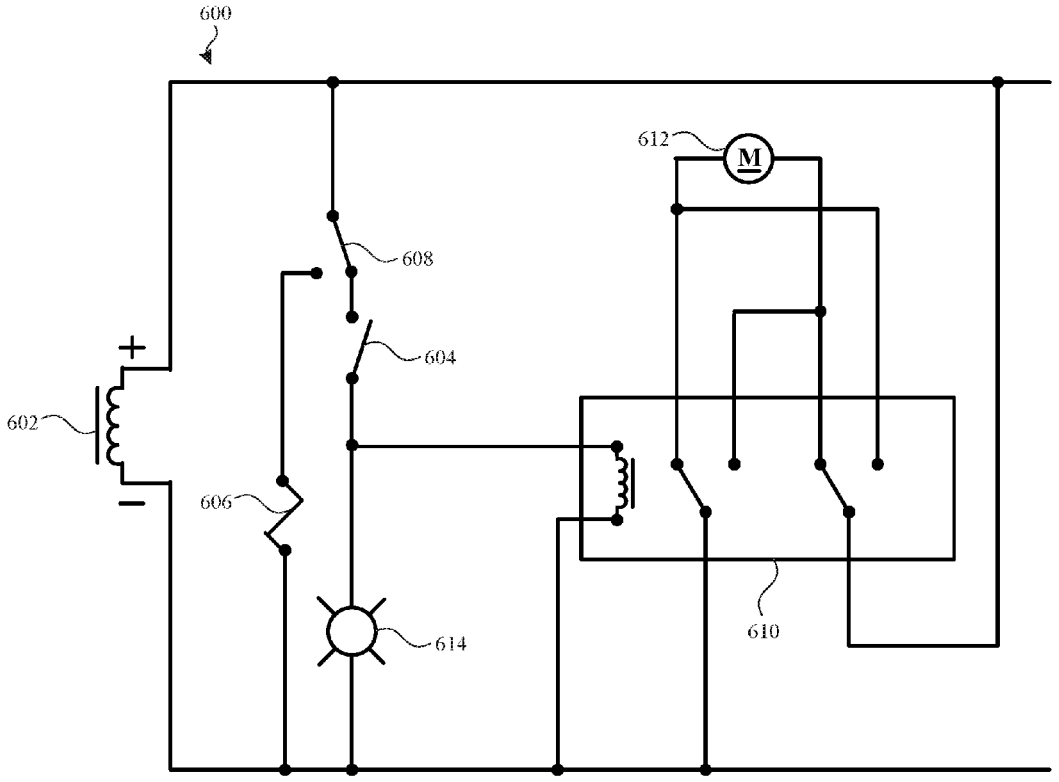
FIG. 6 illustrates a circuit diagram of the electrical connections arranged in one variation that control the operation of an exemplary diverter unit in any configuration.

One variation of the electrical connections between the components of the diverter unit 100 described above are made in accordance with an exemplary circuit diagram 600 depicted in FIG. 6. The circuit diagram 600 includes a 12 vdc power supply 602 to power the diverter unit 100. The circuit diagram 600 also includes a switch 604 that starts the cycle, a switch 606 for the thermal snap disc 306, a DPDT non-latching relay 610, a reversing dc motor diverter valve 612 controlled by the switch 606 and relay 610, a solenoid valve 608 controlled by the switch 606, and an indicator light 614.

Figure 7:
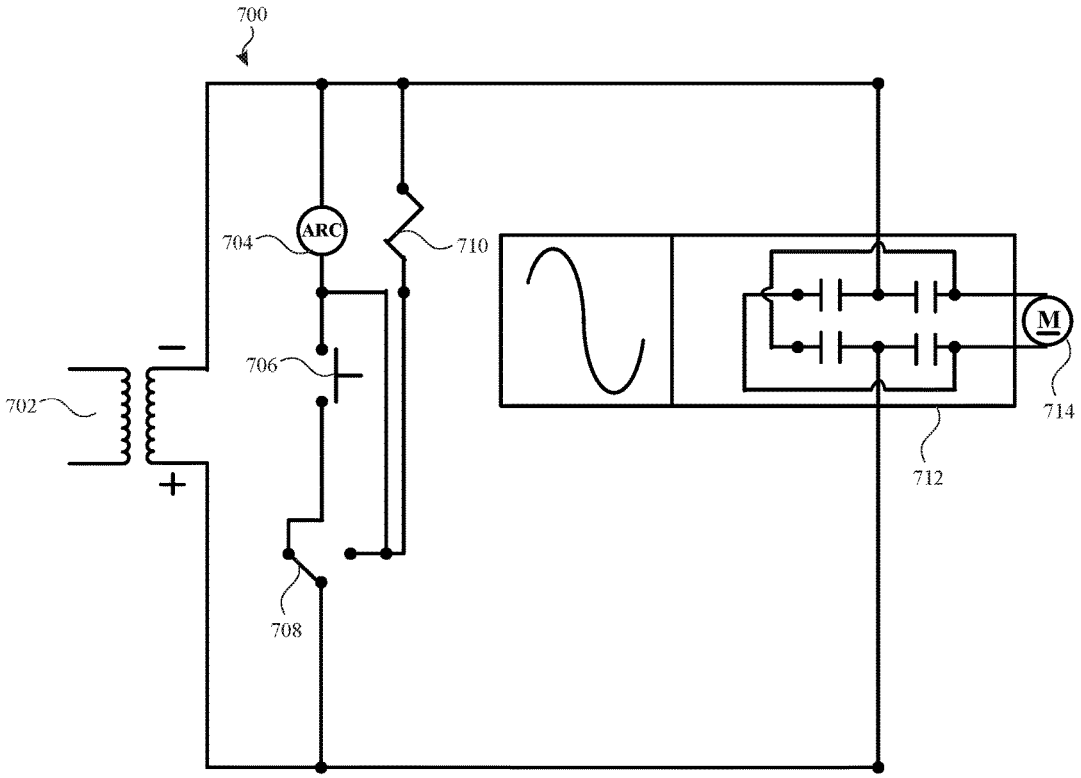
FIG. 7 illustrates a circuit diagram of the electrical connections arranged in one variation that control the operation of an exemplary diverter unit in pushbutton configuration.

Another variation of the of the diverter unit 100 described above are made in accordance with an exemplary circuit diagram 700 depicted in FIG. 7. The circuit diagram 700 includes a power converter 702 that converts ac to dc to power the diverter unit 100, an alternating relay coil 704, a switch 706 for the momentary push button, a thermostat snap disc 708 that switches contacts at 120 degrees Fahrenheit, a solenoid valve coil n/c 710, an alternating relay 712, and a dc motor 704 controlled by the alternating relay 712.

2. Remote Control

The diverter unit 100 in the pushbutton configuration described above may be used with a remote control device. For example, the diverter unit 100 may include a responder unit that is activated by an input on the remote control. The remote control feature of the diverter unit 100 may be provided in addition to or instead of the pushbutton 104.

3. Single-Handle Faucet

Alternatively to the pushbutton configuration, the diverter unit 100 may be used in a single-handle activation configuration. In the single-handle activation configuration, moving the single faucet handle to the hot water position initiates activation of the cycle; otherwise, no hot water is allowed to be discharged. Thus, an added benefit of this configuration is that it keeps the hot water and the cold water separate (by preventing any hot water from being discharged) unless the user requests hot water (by moving the faucet handle to the hot water position). Thus, for example, if the faucet handle is in the neutral position, no hot water will be discharged.

This saves additional water and energy by preventing the use of any hot water when hot water is not specifically requested.

In one exemplary embodiment, when hot water is needed at a point-of-use 108 having a single handle faucet, moving the faucet handle to the hot position closes an internal switch installed in the single handle faucet, thus energizing the solenoid valve 204 and the motorized diverter valve 202. Therefore, instead of the pushbutton 104 described above with respect to the pushbutton configuration, the single-handle activation configuration utilizes an internal switch to initiate activation of the cycle. Further, an indicator light may be installed on or near the faucet to indicate to the user that the handle is moved to the hot water position, and thus that the cycle is active.

Energizing the solenoid valve 204 and the motorized diverter valve 202 causes the solenoid valve 204 to close and the diverter valve 202 to move from Position 1 to Position 2, as depicted in FIG. 3. The closed solenoid valve 204 prevents the accumulated cooled water in the hot water line 112 from flowing to the faucet while the motorized diverter valve # moves from Position 1 to Position 2. Thus, the accumulated cooled water in the hot water line 112 flows through the outlet 202B of the diverter valve 202 and into the holding container 106 until hot water from the hot water source 110 reaches the diverter unit 100.

As with the diverter unit 100 in the pushbutton configuration described above, a thermoswitch 206 is located between the inlet port 102A of the diverter unit 100 and the inlet 202A of the motorized three-way diverter valve 202. In this exemplary embodiment, the thermoswitch 206 is a thermostat snap disc (SPDT) located on the copper nipple just before the motorized three-way diverter valve 202.

The SPDT 206 opens upon detecting that the temperature of passing water is 120 degrees Fahrenheit, thereby causing the diverter valve 202 to return to Position 1 from Position 2 and the solenoid valve 204 to open. This allows hot water to flow through the diverter valve 202 and the solenoid valve 204 and to the faucet at the point-of-use 108.

When hot water is no longer needed, the faucet handle is moved to the off position (by the user). Then, the hot water in the hot water line cools after a period of time and the SPDT 206 returns to its initial position, thus de-energizing the solenoid valve 204 and ending the cycle.

A list of components that may make up the diverter unit 100 in single-handle faucet configuration in accordance with this exemplary embodiment and the sequence of installation are provided below:

(1) 12 vdc power supply input jack;
(2) fuse holder;
(3) 12 vdc, n/o, ½" solenoid valve;
(4) 12 vdc, motorized, ½", three-way diverter valve (returns to Position 1 by removing power, spring loaded);
(5) thermostat snap disc, DPDT, switches at 120 degrees;
(6) diverter unit housing w/2 mounting screws;
(7) 8 blue wire nuts;
(8) 2" of ½" plastic tubing;
(9) 12 vdc power supply, 500 ma o/p with 3' secondary supply cord;
(10) 2 mounting brackets with screws;
(11) 3½" npt to ½" tube male adapter;
(12) 1½" grain of wheat, red, 12 vdc indicator lamp;
(13) 2½" hose clamps;
(14) 1¼" grommet wire holder;
(15) 5' of 28 awg, 4 pair insulated wire;
(16) magnetic switch; and
(17) ½" copper nipple 3" long, type "m" with ½" male npt threads on both ends.

The diverter unit housing (6) has 10 mounting studs for mounting screws, a screw on cover with 3¾" cut outs and 2⅜" cut outs for plumbing and wiring, respectively. Mounting brackets (10) are attached to the 12 vdc solenoid valve (3), the 12 vdc, three-way, motorized diverter valve (4), the fuse holder (2), and the 12 vdc power supply input jack (1). Components (1), (2), (3), and (4) are then mounted to the diverter unit base (6). A ½" copper nipple (type "m") and 3" long w/½" NPS male threads on each end (17) are threaded into the 12 vdc, three-way diverter valve (4) on the right side of the valve (the hot h20 in side). A 120 degree thermostat snap disc, n/c (5), is mounted on the 3" copper nipple (hot h20 in) (17) midway. ½" npt to ½" tubing and male adapters (11) are installed on the left side (outlet side leading to the point-of-use) of the three-way diverter valve (4) and the right side (side facing the diverter valve) of the 12 vdc solenoid valve (3). ½" tubing 2" long (8) is installed between the solenoid valve (3) and the three-way diverter valve (4) using the 2 hose clamps (13). The faucet switch (magnetic) (16) and indicator light (12) are installed in faucet. 4-pair, 28 awg wire (15) is run from the switch (16), down the back of the faucet, inside, to the cabinet below and into the housing (6).

One variation of the electrical connections between the components of the diverter unit 100 described above are made in accordance with an exemplary circuit diagram 600 depicted in FIG. 6. The circuit diagram 600 includes a 12 vdc power supply 602 to power the diverter unit 100. The circuit diagram 600 also includes a switch 604 that starts the cycle, a switch 606 for the thermal snap disc 306, a DPDT non-latching relay 610, a reversing dc motor diverter valve 612 controlled by the switch 606 and relay 610, a solenoid valve 608 controlled by the switch 606, and an indicator light 614.

Figure 8:
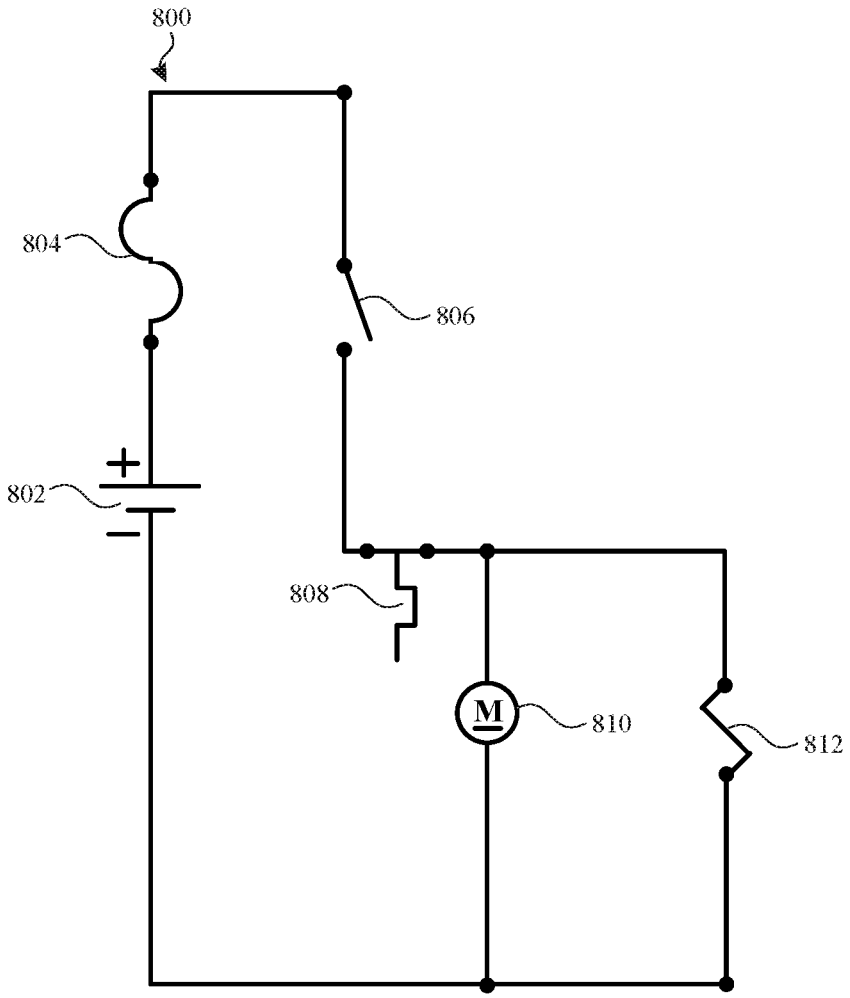
FIG. 8 illustrates a circuit diagram of the electrical connections arranged in one variation that control the operation of an exemplary diverter unit in single-handle faucet configuration.

Another variation of the of the diverter unit 100 described above are made in accordance with an exemplary circuit diagram 800 depicted in FIG. 8. The circuit diagram 800 includes a dc power supply 802 to power the diverter unit 100, a fuse 804 and a fuse switch 806 as a safety precaution, a thermostat snap disc 808 that switches contacts at 120 degrees Fahrenheit, a solenoid valve coil 812, and a dc motor 810.

4. Double-Handle Faucet

The diverter unit 100 in the double-handle faucet configuration described above can also be used with a double-handle faucet having separate hot and cold water handles. For example, with a double-handle faucet, turning on the hot water handle may initiate activation of the cycle. Specifically, as with the single-handle faucet, turning on the hot water faucet handle closes an internal switch in the hot water faucet, thereby initiating activation of the cycle.

What is claimed is:

1. A diverter unit configured to be activated by an activation switch, the diverter unit comprising:
- an inlet port configured to receive water from a hot water source;
- a first outlet port configured to release water to a point-of-use;
- a second outlet port configured to release water to a holding container;
- a three-way diverter valve configured to:
  - direct water from the inlet port towards the first outlet port in a first position,
  - direct water from the inlet port towards the second outlet in a second position, and switch from the first position to the second position upon activation of the activation switch;

a thermoswitch positioned between the diverter valve and the inlet port, wherein the thermoswitch is configured to activate upon detecting that a temperature of passing water is at or above a hot water temperature, wherein the thermoswitch is a thermostat snap disc (SPDT);

a solenoid valve positioned between the diverter valve and the first outlet port, the solenoid valve configured to open upon activation of the thermoswitch; and the three-way diverter valve configured to switch from the second position back to the first position upon activation of the thermoswitch.

2. The diverter unit of claim 1, wherein the solenoid valve is configured to remain open while the thermoswitch is activated and close upon deactivation of the thermoswitch.

3. The diverter unit of claim 1, wherein the solenoid valve is a normally-closed solenoid valve.

4. The diverter unit of claim 1, wherein the three-way diverter valve is a motorized three-way diverter valve.

5. The diverter unit of claim 1, wherein the activation switch is a momentary pushbutton.

6. The diverter unit of claim 1, wherein the activation switch is a responder device to a remote control device.

7. The diverter unit of claim 1, wherein the activation switch is an internal switch configured to be installed in a single-handle faucet and activates upon detecting that the single-handle faucet is moved to a hot water position.

8. The diverter unit of claim 1, wherein activation of the activation switch causes activation of a visual indicator.

9. The diverter unit of claim 1, wherein the diverter unit includes a battery port and is powered via a battery.

10. A method for conserving water using a diverter unit connected to an activation switch, wherein the diverter unit has an inlet port, a first outlet port, a second outlet port, a solenoid valve, a thermoswitch and a diverter valve, wherein the diverter valve is in a first position configured to direct water flow from the inlet port to the first outlet port, and wherein the thermoswitch is a thermostat snap disc (SPDT), the method comprising:

receiving an activation signal from the activation switch;

switching, in response to receiving the activation signal, the position of the diverter valve from the first position to a second position configured to direct water flow from the inlet port to the second outlet port;

detecting, using the thermoswitch, a temperature of water received through the inlet port; and switching the position of the diverter valve to the first position and opening the solenoid valve in response to detecting that the temperature of the received water is at or above a hot water temperature.

11. The method of claim 10, further comprising:

continuing to detect, using the thermoswitch, that the temperature of the received water is at or above the hot water temperature;

maintaining the solenoid valve in the open position if the temperature of the received water remains at or above the hot water temperature; and closing the solenoid valve if the temperature of the received water falls below the hot water temperature.

12. The method of claim 10, wherein the solenoid valve is a normally-closed solenoid valve.

13. The method of claim 10, wherein the three-way diverter valve is a motorized three-way diverter valve.

14. The method of claim 1, wherein the activation switch is a momentary pushbutton.

15. The method of claim 10, wherein the activation switch is a responder device to a remote control device.

16. The method of claim 1, wherein the activation switch is an internal switch configured to be installed in a single-handle faucet and activates upon detecting that the single-handle faucet is moved to a hot water position.

17. The method of claim 1, wherein activation of the activation switch causes activation of a visual indicator.

18. The method of claim 10, wherein the diverter unit includes a battery port and is powered via a battery.

* * * * *